US011056794B2

(12) United States Patent
Hashimoto et al.

(10) Patent No.: US 11,056,794 B2
(45) Date of Patent: Jul. 6, 2021

(54) DUAL-POLARIZED ANTENNA

(71) Applicant: KABUSHIKI KAISHA TOSHIBA, Tokyo (JP)

(72) Inventors: Koh Hashimoto, Yokohama Kanagawa (JP); Makoto Higaki, Setagaya Tokyo (JP); Manabu Mukai, Yokohama Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 16/299,726

(22) Filed: Mar. 12, 2019

(65) Prior Publication Data

US 2019/0207305 A1 Jul. 4, 2019

Related U.S. Application Data

(60) Division of application No. 15/730,173, filed on Oct. 11, 2017, which is a continuation of application No. 14/921,615, filed on Oct. 23, 2015, now abandoned.

(30) Foreign Application Priority Data

Jan. 6, 2015 (JP) ..... 2015-000714

(51) Int. Cl.
*H01Q 9/04* (2006.01)
*H01Q 1/48* (2006.01)

(52) U.S. Cl.
CPC ..... *H01Q 9/0457* (2013.01); *H01Q 1/48* (2013.01); *H01Q 9/0435* (2013.01)

(58) Field of Classification Search
CPC .. H01Q 9/0457; H01Q 9/0407; H01Q 9/0414; H01Q 9/0428; H01Q 9/0435;
(Continued)

(56) References Cited

U.S. PATENT DOCUMENTS 5,355,143 A 10/1994 Zurcher et al.
5,510,803 A * 4/1996 Ishizaka ..... H01Q 21/061 343/700 MS (Continued)

FOREIGN PATENT DOCUMENTS

GB 2219143 A 11/1989
JP H01297905 A 12/1989

(Continued)

*Primary Examiner* — Robert Karacsony
(74) *Attorney, Agent, or Firm* — Holtz, Holtz & Volek PC

(57) ABSTRACT

A method for producing a dual-polarized antenna includes providing first, second and third dielectric substrates with first and second main surfaces. The method includes patterning a conductive film on the first main surface of the first dielectric substrate to form a first ground conductor having an opening and a metal patch as a radiation element, the patch aligned to the opening in a lamination direction, patterning a conductive film on the first main surface of the second dielectric substrate to form a first feed probe configured to excite the metal patch, patterning a conductive film on the second main surface of the second dielectric substrate to form a second ground conductor having a slot generally parallel to the first feed probe, and patterning a conductive film on the second main surface of the third dielectric substrate to form a second feed probe generally perpendicular to the slot.

9 Claims, 6 Drawing Sheets

(58) Field of Classification Search
CPC .... H01Q 9/045; H01Q 9/0464; H01Q 9/0478; H01Q 1/48
See application file for complete search history.

(56) References Cited

U.S. PATENT DOCUMENTS

| | | | | | |
|---|---|---|---|---|---|
| 6,091,364 | A * | 7/2000 | Murakami | H01Q 1/084 | 343/700 MS |
| 8,350,771 | B1 * | 1/2013 | Zaghloul | H01Q 9/0435 | 343/700 MS |
| 2004/0119645 | A1 * | 6/2004 | Lee | H01Q 9/0457 | 343/700 MS |
| 2007/0052587 | A1 * | 3/2007 | Cheng | H01Q 9/0407 | 343/700 MS |

FOREIGN PATENT DOCUMENTS

| | | | |
|---|---|---|---|
| JP | 02101802 | A | 4/1990 |
| JP | 05-243836 | * | 9/1993 |
| JP | 05243836 | A | 9/1993 |
| JP | 2002033617 | A | 1/2002 |

* cited by examiner

DUAL-POLARIZED ANTENNA

CROSS-REFERENCE TO RELATED APPLICATIONS

This application is a Divisional application of U.S. application Ser. No. 15/730,173, filed Oct. 11, 2017, which is a Continuation application of U.S. application Ser. No. 14/921,615, filed Oct. 23, 2015, which is based upon and claims the benefit of priority from Japanese Patent Application No. 2015-000714, filed Jan. 6, 2015. The entire contents of all the above-identified applications are incorporated herein by reference.

FIELD

Embodiments described herein relate generally to a polarization shared antenna.

BACKGROUND

In the related art, there is a dual-polarized antenna which radiates two polarized waves which cross at a predetermined angle such as 90°, etc. Each of radiation elements, ground conductors, and multiple feed probes, etc., are laminated in this dual-polarized antenna. However, an increase in misalignment between laminated member layers could cause a degradation in various antenna characteristics such as cross polarization discrimination, etc.

DETAILED DESCRIPTION

Figure 1:
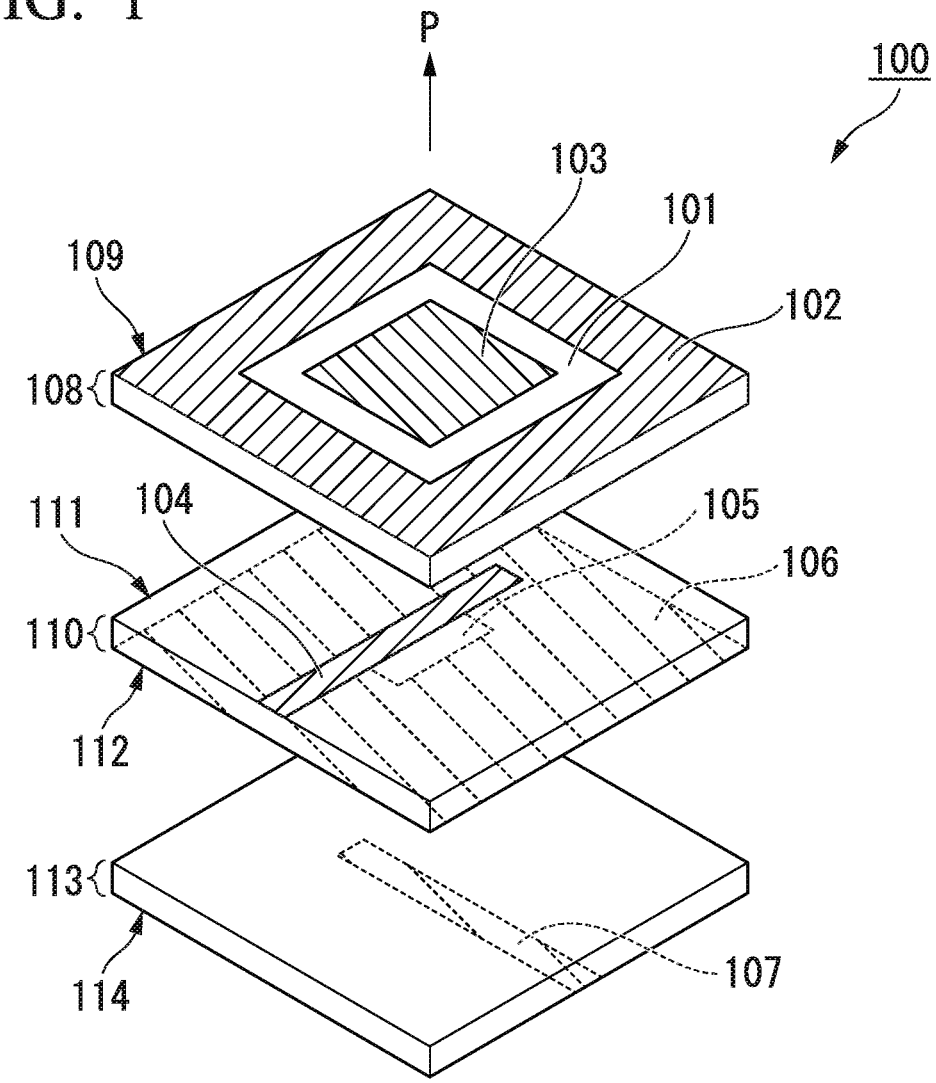
FIG. 1 is a diagrammatic perspective view which schematically illustrates a configuration of a dual-polarized antenna according to an embodiment.

In some cases, a dual-polarized antenna may include, but is not limited to, a first ground conductor having an opening; a metal patch as a radiation element, a first feed probe; a second ground conductor; a second feed probe; and a first dielectric substrate. The metal patch as a radiation element is positioned equal to or lower in level in a lamination direction than the first ground conductor. The metal patch is aligned to the opening in the lamination direction. The first feed probe is positioned under the first ground conductor in the lamination direction. The first feed probe excites the metal patch. The second ground conductor is positioned below the first feed probe in the lamination direction. The second ground conductor has a slot which is generally parallel to the first feed probe. The slot is positioned under the metal patch in the lamination direction. The second feed probe is disposed under the second ground conductor in the lamination direction, the second feed probe being generally perpendicular to the slot. The second feed probe is positioned under the metal patch. The first dielectric substrate has a first main surface on which the first probe is disposed and a second main surface on which the second ground conductor is disposed.

In some cases, the antenna may further include a third ground conductor disposed under the second feed probe in the lamination direction.

In some cases, the antenna may further include a second metal patch positioned under the second ground conductor and above the third ground conductor in the lamination direction. The second feed probe has an longitudinal axis which is generally perpendicular to the slot from a view parallel to the lamination direction.

In some cases, the antenna may further include at least one metal post disposed at the periphery of the opening.

In some cases, the opening has a shape of rectangle. The at least one metal post may include a plurality of metal posts which includes four pairs of metal posts, each pair of which is disposed along a respective one of the four sides of the periphery of the opening.

In some cases, the antenna may further include a plurality of sets each comprising the opening, the metal patch, the first feed probe, the slot, and the second feed probe, a first feed circuit which connects the plurality of first feed probes; and a second feed circuit which connects the plurality of second feed probes.

In other aspects, a dual-polarized antenna may include, but is not limited to, a first dielectric substrate having a first surface and a second surface opposite to the first surface a first ground conductor disposed on the first surface of the first dielectric substrate, the first ground conductor having an opening; a second dielectric substrate having a first surface and a second surface opposite to the first surface, the first surface of the second dielectric substrate facing to the second surface of the first dielectric substrate, a first metal patch disposed on the first surface of the second dielectric substrate, a second ground conductor disposed on the second surface of the second dielectric substrate, the second ground conductor having a slot; a first feed probe disposed on the first surface of the second dielectric substrate, the first feed probe being connected to the first metal patch; a third dielectric substrate having a first surface and a second surface opposite to the first surface, the first surface of the third dielectric substrate facing to the second surface of the second dielectric substrate; a second metal patch disposed on the second surface of the third dielectric substrate, the slot being positioned between the first and second metal patches; and a second feed probe disposed on the second surface of the third dielectric substrate, the second feed probe being connected to the second metal patch.

In some cases, the antenna may further include a fourth dielectric substrate having a first surface and a second surface opposite to the first surface, the first surface of the fourth dielectric substrate facing to the second surface of the third dielectric substrate; and a third ground conductor disposed on the second surface of the fourth dielectric substrate.

In some cases, the first metal patch is smaller in area than the second metal patch, and the second metal patch is smaller in area than the opening.

In still other cases, a dual-polarized antenna may include, but is not limited to, a first ground conductor having an opening; a metal patch disposed in the opening and separate from the first ground conductor, a dielectric substrate having a first main surface and a second main surface opposite to the first main surface; a second ground conductor disposed on the second main surface of the dielectric substrate, the second ground conductor having at least one of an empty space and a non-empty space of insulator; a first feed probe disposed on the first main surface of the dielectric substrate, the first feed probe being coupled to the metal patch; and a second feed probe being spatially separated by at least one of the empty space and the non-empty space of insulator from the first feed probe, the second feed probe being coupled to the metal patch through at least one of the empty space and the non-empty space of insulator.

In some cases, the first feed probe is configured to be electromagnetically coupled to the metal patch.

In some cases, the second feed probe is configured to be electromagnetically coupled through at least one of the empty space and the non-empty space of insulator to the metal patch.

In some cases, the first ground conductor has at least one opening which is larger in size than the metal patch.

In some cases, the first ground conductor has at least one opening which is larger in size than the metal patch, and the metal patch is positioned in the at least one opening, and the metal patch is substantially the same in level as the first ground conductor.

In some cases, at least one of the empty space and the non-empty space of insulator is generally parallel in longitudinal direction to the first feed probe, the non-empty slot is positioned between the first feed probe and the empty slot. For example, the empty space may typically be a slot which is a narrow hole without any filler. The non-empty space of insulator may typically be a slot which is filled with any available insulating material which is less in conductivity than the first ground conductor.

In some cases, the metal patch and at least one of the empty space and the non-empty space of insulator overlap each other at least in part from a view vertical to the surface of at least one of the first and second ground conductors.

In some cases, the first and second feed probes cross each other in an overlap area in which the metal patch and at least one of the empty space and the non-empty space of insulator overlap from a view vertical to the surface of at least one of the first and second ground conductors.

In some cases, the metal patch and at least one of the empty space and the non-empty space of insulator overlap each other at least in part from a view vertical to the surface of at least one of the first and second ground conductors. The first and second feed probes cross each other in an overlap area in which the metal patch and at least one of the empty space and the non-empty space of insulator overlap from the view.

In some cases, at least one of the empty space and the non-empty space of insulator has a dimension which allows an impedance matching between the metal patch and the second feed probe at a frequency lower than a resonant frequency of the metal patch.

Various embodiments of the dual-polarized antenna will be described hereinafter with reference to the accompanying drawings.

As shown in FIG. 1, a dual-polarized antenna 100 according to an embodiment includes a first ground conductor 102 in which an opening 101 is provided, a metal patch 103, a first feed probe 104, a second ground conductor 106 in which a slot 105 is provided, and a second feed probe 107. For example, the slot 105 may be an empty space or a non-empty space. The empty space may typically be a slot which is a narrow hole without any filler. The non-empty space of insulator may typically be a slot which is filled with any available insulating material which is less in conductivity than the first ground conductor.

The external form of the opening 101 is rectangular. The opening 101 is provided at a central portion of the first ground conductor 102.

The external form of the metal patch 103 is rectangular. The metal patch 103 is formed such that the size thereof is smaller than the size of the opening 101. In this way, the metal patch 103 and the first ground conductor 102 are arranged at the same height position in the laminated direction P.

The first ground conductor 102 and the metal patch 103 are formed on a first main surface 109 of a first dielectric substrate 108. The first dielectric substrate 108 is an insulator such as a resin substrate, a ceramic substrate, formed plastic, a film substrate, etc., for example. The first ground conductor 102 and the metal patch 103 are formed with a conductive material to be patterned, etc., on the first main surface 109 of the first dielectric substrate 108.

The external form of the first feed probe 104 is rectangular. The first feed probe 104 is arranged below the metal patch 103 and the first ground conductor 102 via the first dielectric substrate 108 in the laminated direction P. A portion of the first feed probe 104 is arranged below the central portion (for example, the center) of the metal patch 103 in the laminated direction P.

The first feed probe 104 is formed on a first main surface 111 of a second dielectric substrate 110. The second dielectric substrate 110 is an insulator such as a resin substrate, a ceramic substrate, formed plastic, a film substrate, etc., for example. The first feed probe 104 is formed with a conductive material to be patterned, etc., on the first main surface 111 of the second dielectric substrate 110.

The first feed probe 104 excites the metal patch 103 through proximity coupled feeding by electromagnetically coupling with the metal patch 103. In this way, the metal patch 103 transmits and receives a first polarized wave which is parallel in the longitudinal direction of the first feed probe 104.

The external form of the slot 105 is rectangular. The second ground conductor 106 in which the slot 105 is provided is arranged below the first feed probe 104 via the second dielectric substrate 110 in the laminated direction P. A central portion (for example, the center) of the slot 105 is arranged below the central portion (for example, the center) of the metal patch 103 in the laminated direction P. The slot 105 is arranged such that the longitudinal direction of the slot 105 is generally parallel to the longitudinal direction of the first feed probe 104. The slot 105 has the dimension in the longitudinal direction set such that it provides impedance matching with feeding to the metal patch 103 by the below-described second feed probe 107. The slot 105 and the second ground conductor 106 are formed with a conductive material to be patterned, etc., on the second main surface 112 of the second dielectric substrate 110.

A patterning misalignment error when the first feed probe 104 is formed on the first main surface 111 of the second dielectric substrate 110 and when the second ground conductor 106 in which the slot 105 is formed on the second main surface 112 is approximately several tens of micrometers. This patterning misalignment error is smaller than an interlayer misalignment error when a first substrate on which the first feed probe 104 is formed and a second substrate on which the second feed probe 106 is formed are laminated, for example. The interlayer misalignment error when different substrates are laminated varies in accordance with materials to be laminated, a method of lamination, the number of layers to be laminated, etc., and is approximately several hundreds of micrometers, etc.

When the first feed probe 104 and the second ground conductor 106 are formed by patterning on the second dielectric substrate 110, first a conductor film with a conductive material such as copper, etc., is pasted on the second main surface 112 and the first main surface 111 of the second dielectric substrate 110. In this case, the first main surface 111 and the second main surface 112 of the second dielectric substrate 110 may be roughened and the conductor film may be directly pasted thereon to secure the adhesive strength by anchoring effect. Moreover, the conductor film may be bonded via a bonding layer onto the second main surface 112 and the first main surface 111 of the second dielectric substrate 110.

Next, the conductor film is etched in each of the first main surface 111 and the second main surface 112 of the second dielectric substrate 110 to form the second ground conductor 106 in which the first feed probe 104 and the slot 105 are provided.

The external form of the second feed probe 107 is rectangular. The second feed probe 107 is arranged below the second ground conductor 106 via a third dielectric substrate 113 in the laminated direction P. A portion of the second feed probe 107 is arranged below the central portion (for example, the center) of the metal patch 103 in the laminated direction P. The second feed probe 107 is arranged such that the longitudinal direction of the second feed probe 107 is generally orthogonal to the longitudinal direction of the slot 105.

The second feed probe 107 is formed with a conductive material, etc., to be patterned on the second main surface 114 of the third dielectric substrate 113.

The second feed probe 107 excites the metal patch 103 through slot coupled feeding by electromagnetically coupling with the metal patch 103 via the slot 105. In this way, the metal patch 103 transmits and receives a second polarized wave (or, in other words, the second polarized wave which is almost orthogonal to the first polarized wave) in the longitudinal direction of the slot 105.

The above-described embodiment makes it possible to reduce a position misalignment error by having the first feed probe 104 patterned in the first main surface 111 of the second dielectric substrate 110 and the slot 105 patterned in the second main surface 112 thereof. For example, the above-described embodiment makes it possible to improve the precision of the relative position of the first feed probe 104 and the slot 105 relative to a case in which a different substrate is laminated after the first feed probe 104 and the slot 105 are formed in different substrates, for example. The first feed probe 104 and the slot 105 for which the position misalignment error is reduced make it possible to prevent degradation of various antenna characteristics such as cross polarization discrimination, reflection characteristics, port isolation, etc.

Having the first feed probe 104 and the slot 105 for which the mutual longitudinal directions are generally parallel makes it possible to suppress coupling of the first feed probe 104 and the slot 105 and to suppress a cross polarization component which is orthogonal to a main polarized wave which is parallel to the first feed probe 104 from being generated. Having the first feed probe 104 and the slot 105 for which the mutual coupling is suppressed makes it possible to prevent degradation of the cross polarization discrimination.

Moreover, having the first feed probe 104 with the longitudinal direction which is generally parallel in the longitudinal direction of the slot 105 and having the second feed probe 107 with the longitudinal direction which is generally orthogonal in the longitudinal direction of the slot 105 make it possible to improve the cross polarization discrimination.

Furthermore, the first feed probe 104 and the second feed probe 107 whose mutual longitudinal directions are generally orthogonal make it possible to improve isolation between an input/output port to which the first feed probe 104 is connected and an input/output port to which the second feed probe 107 is connected.

Below, variations are described.

While the external form of each of the opening 101, the metal patch 103, the first feed probe 104, the slot 105, and the second feed probe 107 is described as being rectangular in the above-described embodiment, it is not limited thereto. While the external form of each of the opening 101, the metal patch 103, the first feed probe 104, the slot 105, and the second feed probe 107 is described as being polygonal, circular, or a different complex shape.

Below, a first variation is described.

In the above-described embodiment, a third ground conductor 215 may be provided below the second feed probe 107 in the lamination direction P.

Figure 2:
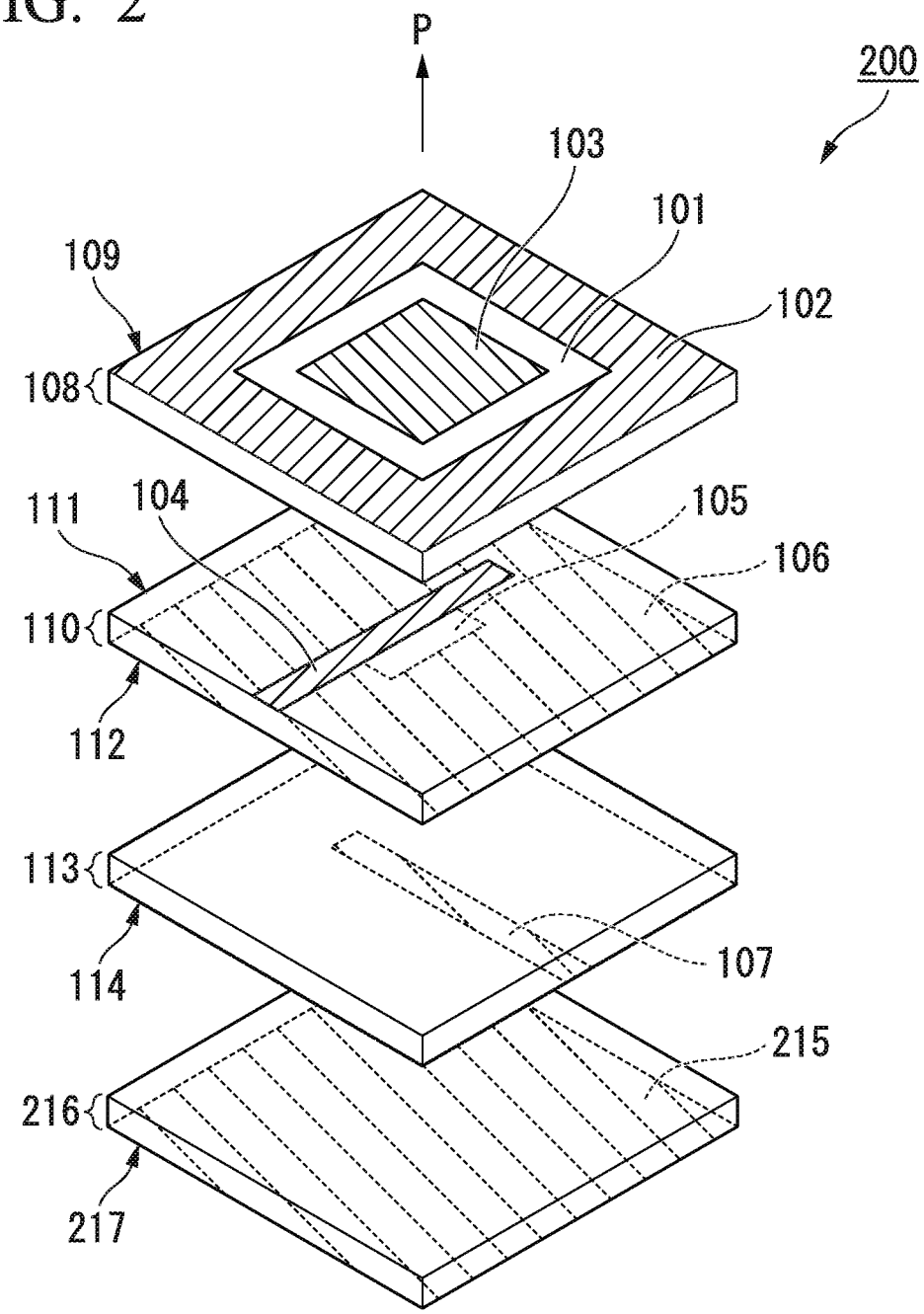
FIG. 2 is a diagrammatic perspective view which schematically illustrates a configuration of the dual-polarized antenna according to a first variation of the embodiment.

As shown in FIG. 2, a dual-polarized antenna 200 according to the first variation includes the first ground conductor 102 in which the opening 101 is provided, the metal patch 103, the first feed probe 104, the second ground conductor 106 in which the slot 105 is provided, the second feed probe 107, and a third ground conductor 215. The dual-polarized antenna 200 according to the first variation is different from the dual-polarized antenna 100 according to the above-described embodiment in that the third ground conductor 215 is provided.

Below, while omitting or simplifying the explanations for the same parts as the parts in the dual-polarized antenna 100 according to the above-described embodiment, points thereof which are different from those of the above-described dual-polarized antenna 100 are explained.

A third ground conductor 215 is formed on a second main surface 217 of a fourth dielectric substrate 216. The fourth dielectric substrate 216 is, for example, an insulator such as the resin substrate, the ceramic substrate, the foam plastic, or the film substrate. The third ground conductor 215 is formed with a conductive material, etc., to be patterned on the second main surface 217 of the fourth dielectric substrate 216.

The second ground conductor 106 and the third ground conductor 215, and the second feed probe 107, which is arranged between the second ground conductor 106 and the third ground conductor 215, form a stripline (a triplate line).

The first variation having the second ground conductor 106 and the third ground conductor 215 that sandwiches the second feed probe 107 from both sides of the lamination direction P, may suppress unwanted radiation to the reverse direction of the metal patch 103 from the second feed probe 107 to improve the antenna gain.

For example, it may suppress unwanted radiation in the downward lamination direction P when a radio wave is directed in the upward lamination direction P when the dual-polarized antenna 200 is used in satellite communications, etc., for example.

Below, a second variation is explained.

While the metal patch 103 is described as being arranged at the same height position as the first ground conductor 102 in the lamination direction P by being arranged inside the opening 101 in the above-described embodiment, it is not limited thereto.

Moreover, while the first feed probe 104 is described as being arranged below the metal patch 103 via the first dielectric substrate 108 in the lamination direction P, it is not limited thereto.

Figure 3:
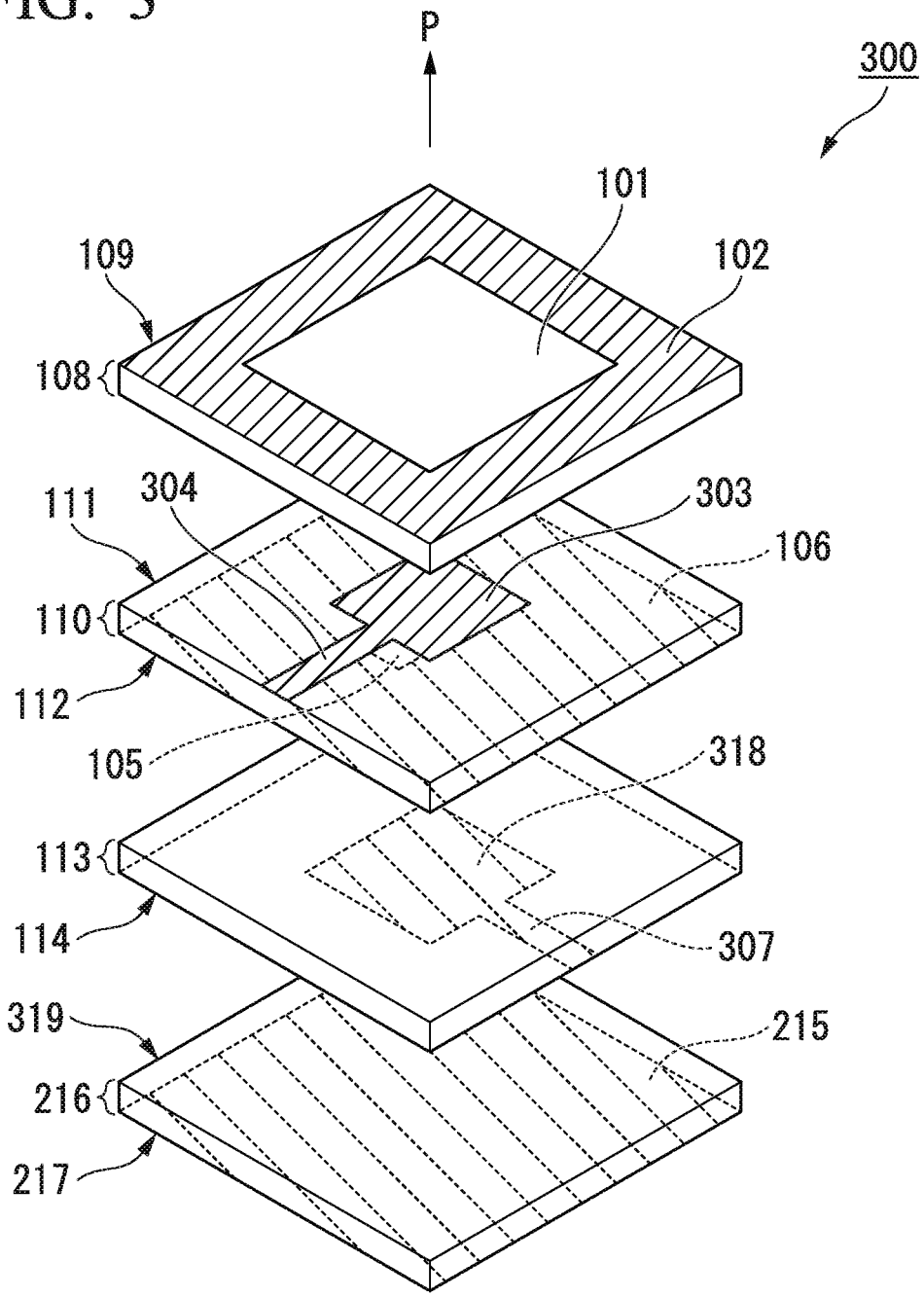
FIG. 3 is a diagrammatic perspective view which schematically illustrates the configuration of the dual-polarized antenna according to a second variation of the embodiment.

As shown in FIG. 3, a dual-polarized antenna 300 according to the second variation includes the first ground conductor 102 in which the opening 101 is provided, a metal patch 303, a first feed probe 304, the second ground conductor 106 in which the slot 105 is provided, a second feed probe 307, and a second metal patch 318. The dual-polarized antenna 300 according to the second variation is different from the dual-polarized antenna 200 according to the above-described first variation in that the metal patch 303, the first feed probe 304, the second feed probe 307, and the second metal patch 318 are provided.

Below, while omitting or simplifying the explanations for the same parts as the parts in the dual-polarized antenna 200 according to the above-described first variation, points thereof which are different from those of the above-described dual-polarized antenna 200 are explained.

The external form of the first metal patch 303 is rectangular. The first metal patch 303 is formed such that the size thereof is smaller than the size of the opening 101. The first metal patch 303 is arranged below the first ground conductor 102 via the first dielectric substrate 108 in the lamination direction P. The first metal patch 303 is provided such that an orthographic projection onto the first ground conductor 102 is inside the opening 101.

The external form of the first metal patch 304 is rectangular. The first metal probe 304 is formed such that the first metal probe 304 is arranged below the first ground conductor 102 via the first dielectric substrate 108 in the lamination direction P. The first feed probe 304 is arranged such that the longitudinal direction of the first feed probe 304 is generally parallel to the longitudinal direction of the slot 105. The first feed probe 304 is connected to the first metal patch 303. In this way, the first metal patch 303 and the first feed probe 304 are arranged at the same height position in the lamination direction P.

The first metal patch 303 and the first feed probe 304 are formed by a dielectric, etc., which is patterned on the first main surface 111 of the second dielectric substrate 110.

The first feed probe 304 excites the first metal patch 303 by coplanar feeding by being electrically-connected with the first metal patch 303. In this way, the first metal patch 303 transmits and receives a first polarized wave which is parallel to the longitudinal direction of the first feed probe 304.

The external form of the second feed probe 307 is rectangular. The second feed probe 307 is arranged below the second ground conductor 106 via the third dielectric substrate 113 in the lamination direction P. The second feed probe 307 is arranged such that the longitudinal direction of the second feed probe 307 is arranged to be generally orthogonal to the longitudinal direction of the slot 105. The second feed probe 307 is connected to the second metal patch 318. In this way, the second feed probe 307 and the second metal patch 318 are arranged at the same height position in the lamination direction P.

The external form of the second metal patch 318 is rectangular. The second metal patch 318 is formed such that it has the size which is smaller than the size of the opening 101 and larger than the size of the first metal patch 303. The second metal patch 318 is arranged below the second ground conductor 106 via the third dielectric substrate 113 in the lamination direction P. The second metal patch 318 is provided at a position at which an orthographic projection onto the first ground conductor 102 is provided at a position inside the opening 101.

The second feed probe 307 and the second metal patch 318 are formed by a conductive material to be patterned, etc., on the second main surface 114 of the third dielectric substrate 113.

The second feed probe 307 excites the first metal patch 303 through slot coupled feeding by electromagnetically coupling with the first metal patch 303 via the slot 105. In this way, the first metal patch 303 transmits/receives a second polarized wave (or, in other words, the second polarized wave which is orthogonal to the first polarized wave) which is orthogonal to the longitudinal direction of the slot 105. In this case, the second metal patch 318 which is electrically-connected to the second feed probe 307 operates as a feeding element. The first metal patch 303 operates as a non-feeding element (a parasitic element).

The second variation, which has the second metal patch 318 which operates as the feeding element and the first metal patch 303 which operates as the non-feeding element (a parasitic element), makes it possible to increase the bandwidth of the second polarized wave by feeding of the second feed probe 307.

While it is described that the external form of each of the first metal patch 303, the first feed probe 304, the second feed probe 307, and the second metal patch 318 is rectangular, it is not limited thereto. The external form of each of the first metal patch 303, the first feed probe 304, the second feed probe 307, and the second metal patch 318 may be polygonal, circular, or a different complex shape, for example.

While the first ground conductor 102 is arranged to be formed on the first main surface 109 of the first dielectric substrate 108 in the above-described second variation, it is not limited thereto.

A metal plate, which is the first ground conductor 102 in which the opening 101 is provided, is laminated onto the first main surface 111 of the second dielectric substrate 110 in which the first metal patch 303 and the first feed probe 304 may be formed via an insulator.

While it is described in the above-described second variation that the second feed probe 307 and the second metal patch 318 are formed on the second main surface 114 of the dielectric substrate 113 in the above-described second variation, it is not limited thereto.

The second feed probe 307 and the second metal patch 318 may be formed on the first main surface 219 of the fourth dielectric substrate 216.

While it is described in the above-described second variation that the first metal patch 303 and the first feed probe 304, and the second feed probe 307 and the second metal patch 318 are respectively on the same plane and are electrically connected, it is not limited thereto. A metal layer may be added to use a different feeding mode other than the coplanar feeding.

Between the first metal patch 303 and the first feed probe 304 and between the second feed probe 307 and the second metal patch 318, proximity coupling feeding by mutual electromagnetic coupling, back-feeding by being connected by a metal via, etc., may be used.

Below a third variation is described.

In the above-described embodiment, multiple metal posts 420 are arranged so as to surround the periphery of the opening 101.

Figure 4:
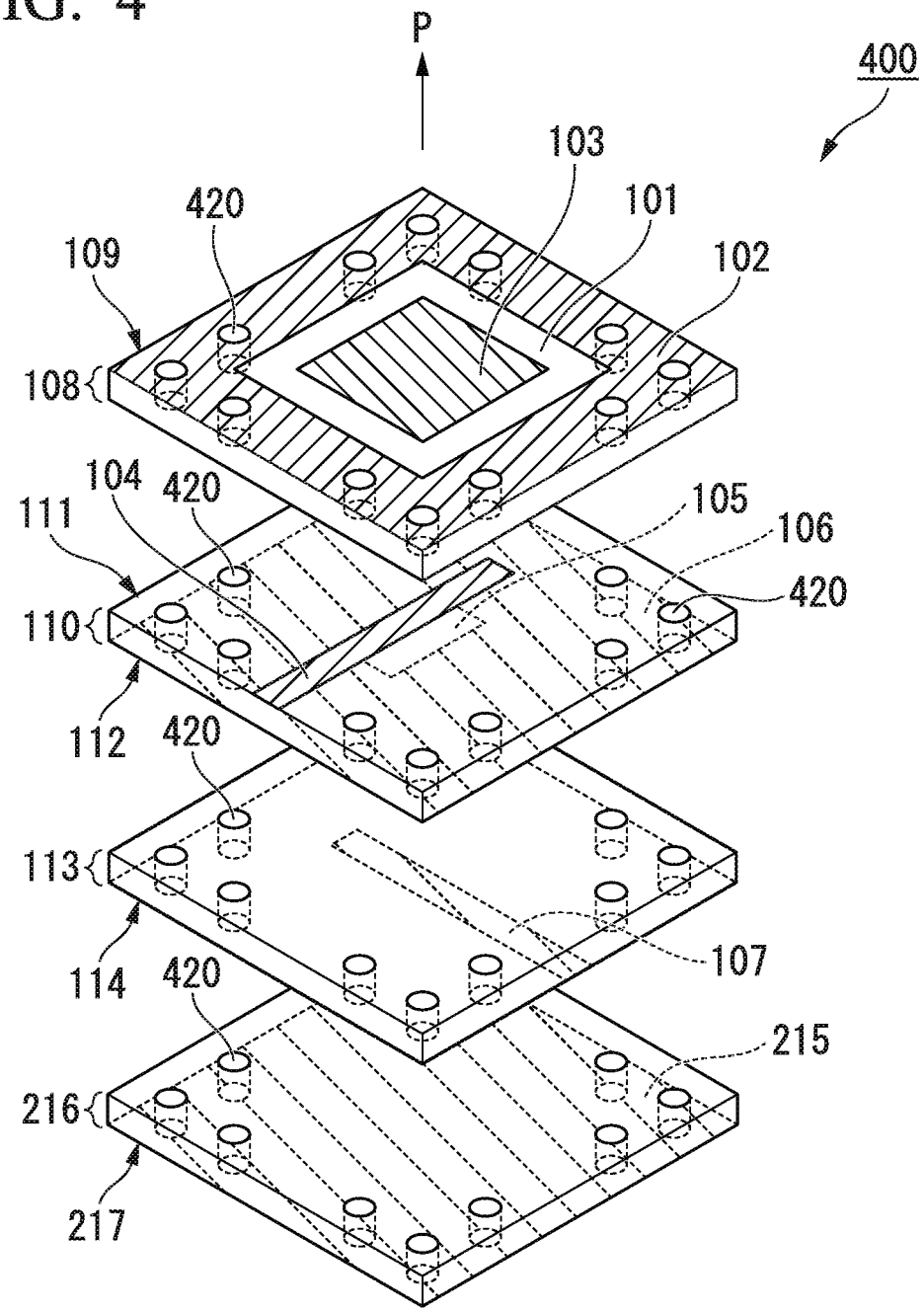
FIG. 4 is a diagrammatic perspective view which schematically illustrates the configuration of the dual-polarized antenna according to a third variation of the embodiment.

As shown in FIG. 4, a dual-polarized antenna 400 according to the third variation includes the first ground conductor 102 in which the opening 101 is provided, the metal patch 103, the first feed probe 104, the second ground conductor 106 in which the slot 105 is provided, the second feed probe 107, and multiple metal posts 420. The dual-polarized antenna 400 according to the third variation is different from the dual-polarized antenna 200 according to the above-described first variation in that it includes the multiple metal posts 420.

Below, while explanations are omitted or simplified for the same part as the dual-polarized antenna 200 according to the above-described first variation, points which are different from the dual-polarized antenna 200 according to the above-described first variation are described.

The first ground conductor 102 and the second ground conductor 106, and the first feed probe 104, which is arranged between the first ground conductor 102 and the second feed conductor 106, form a stripline (a triplate line).

The second ground conductor 106 and the third ground conductor 215, and the first feed probe 107, which is arranged between the second ground conductor 106 and the third feed conductor 215, form a stripline (a triplate line).

Multiple metal posts 420 are mounted in multiple through holes which penetrate each of the first dielectric substrate 108, the second dielectric substrate 110, the third dielectric substrate 113, and the fourth dielectric substrate 216. Multiple metal posts 420 include two metal posts 420 that are arranged along the respective sides of the rectangular opening 101 and a metal post 420 arranged outside each apex of the rectangular opening 101. Each of the multiple metal posts 420 short-circuits between the first ground conductor 102 and the second ground conductor 106 and between the second ground conductor 106 and the third ground conductor 215.

The third variation, which has the multiple metal posts 420, makes it possible to suppress a parallel plate mode which occurs within a parallel plate waveguide which is formed by each of the first ground conductor 102 and the second ground conductor 106 and the second ground conductor 106 and the third ground conductor 215. The third variation, which has the multiple metal posts 420 for suppressing the parallel plate mode, may suppress degradation of radiation directivity due to a decrease in the radiation efficiency of the metal patch 103 and leakage from an end of the metal patch 103. Moreover, in an array antenna including the multiple metal patches 103, unwanted coupling between neighboring metal patches 103 may be suppressed and degradation of the antenna characteristics may be prevented.

While it is described that the above described third variation includes the third ground conductor 215, it is not limited thereto, so that the third ground conductor 215 may be omitted.

In the above described third variation, the multiple metal posts 420 may be independently provided in each of the first dielectric substrate 108, the second dielectric substrate 110, the third dielectric substrate 113, and the fourth dielectric substrate 216.

In the above described third variation, the multiple metal posts 420 may be through holes, etc., which integrally penetrate the first dielectric substrate 108, the second dielectric substrate 110, the third dielectric substrate 113, and the fourth dielectric substrate 216.

In the above described third variation, the multiple metal posts 420 may be a metal via which is stacked when each of the first dielectric substrates 108, the second dielectric substrate 110, the third dielectric substrate 113, and the fourth dielectric substrate 216 is fabricated by a buildup method.

Below, a fourth variation is described.

While the above-described third variation is arranged to include multiple metal posts which are arranged so as to surround the opening 101, it is not limited thereto. In the above-described third variation, the set of one metal post 420 that is arranged outside each apex of the rectangular opening 101 may be omitted.

Figure 5:
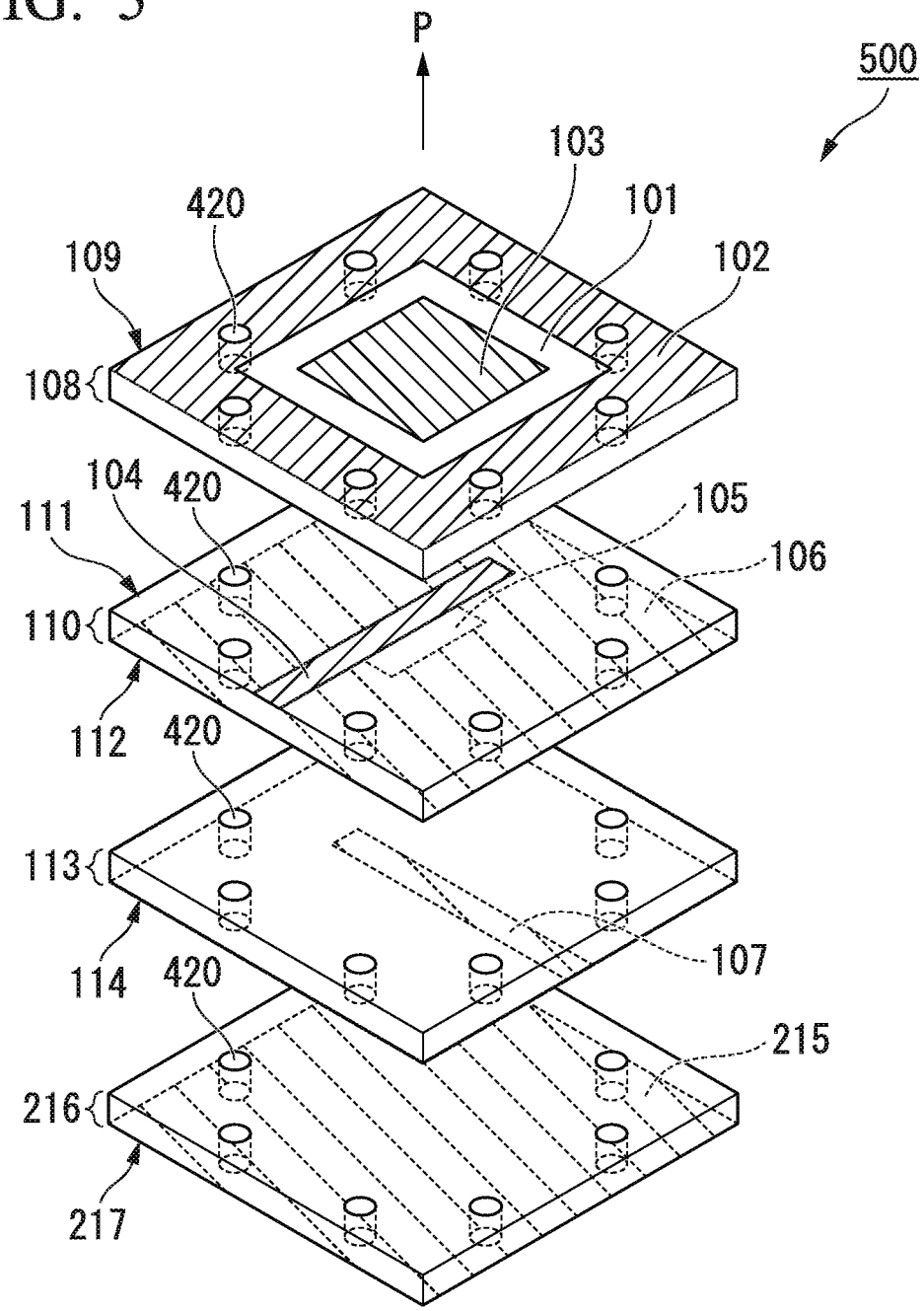
FIG. 5 is a diagrammatic perspective view which schematically illustrates the configuration of the dual-polarized antenna according to a fourth variation of the embodiment.

As shown in FIG. 5, a dual-polarized antenna 500 according to the fourth variation includes the set of two metal posts 420 that are arranged along each side of the rectangular opening 101 as multiple metal posts 420.

According to the fourth variation, in the array antenna which includes multiple metal patches 103, a location for laying a feed circuit in the array antenna may be secured while suppressing unwanted coupling between neighboring metal patches 103. This makes it possible to increase the degree of freedom of the layout of the feed circuit.

While the fourth variation is arranged to include the third ground conductor 215, it is not limited thereto, so that the third ground conductor 215 may be omitted.

Below, a fifth variation is described.

While one each of the opening 101, the metal patch 103, and the slot 105 may be provided in the above-described embodiment, it is not provided thereto.

Figure 6:
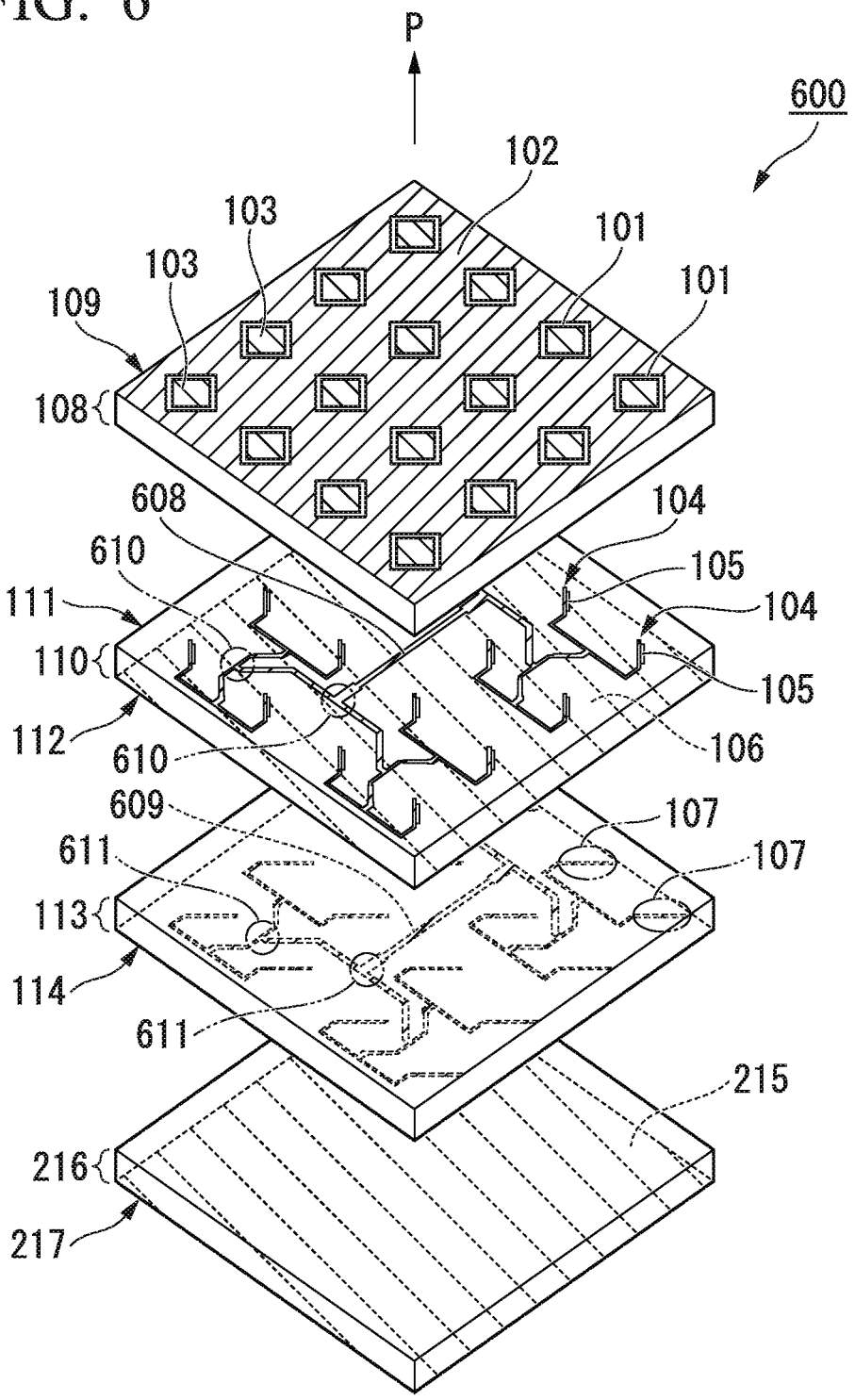
FIG. 6 is a diagrammatic perspective view which schematically illustrates the configuration of the dual-polarized antenna according to a fifth variation of the embodiment.

As shown in FIG. 6, a dual-polarized antenna 600 in the fifth variation includes the first ground conductor 102 in which multiple openings 101 are provided, multiple metal patches 103, multiple first feed probes 104, the second ground conductor 106 in which multiple slots 105 are provided, multiple second feed probes 107, a third ground conductor 215, a first feed circuit 608, and a second feed circuit 609. A dual-polarized antenna 600 according to the fifth variation includes an array antenna in which multiple of the dual-polarized antennas 200 in the first variation of the above-described embodiment as described above is made into an array in a lattice. Each of the multiple openings 101, the multiple metal patches 103, the multiple first feed probes 104, the multiple slots 105, and the multiple second feed probes 107 are arranged in a lattice.

As described below, while the same parts as the above-described dual-polarized antenna 200 of the first variation is omitted or simplified, points which are different from the above-described dual-polarized antenna 200 of the above-described first variation is described.

Each of the multiple openings 101, the multiple metal patches 103, and the multiple slots 105 are arranged in a lattice in equal intervals in a direction which is generally 45° tilted relative to the respective polarization directions of the first polarized wave and the second polarized wave. The number of each of the multiple openings 101, the multiple metal patches 103, and the multiple slots 104 is $2^N \times 2^N$ with N as an arbitrary natural number.

The first feed circuit 608 is a parallel-feeding type feed circuit having a symmetrical structure of a so-called complete tournament-type. The first feed circuit 608 includes multiple T-type branches 610 connected in multiple stages. Each of the multiple T-type branches 610 divides input power into two. The multiple first feed probes 104 are connected to multiple ends of the first feed circuit 608.

The second feed circuit 609 is a parallel-feeding type feed circuit having a symmetrical structure of a so-called complete tournament-type. The second feed circuit 609 includes multiple T-type branches 611 connected in multiple stages. Each of the multiple T-type branches 611 divides input power into two. The multiple second feed probes 107 are connected to multiple ends of the second feed circuit 609.

The fifth variation, having the multiple slots 105 which are patterned on the second main surface 112 and multiple first feed probes 104 which are patterned on the first main surface 111 of the second dielectric substrate 110, makes it possible to reduce a misalignment error. Having the multiple first feed probes 104 and slots 105 for which the alignment error is reduced causes prevention of degradation of various antenna characteristics such as the cross polarization discrimination, reflection characteristics, inter-port isolation, etc.

The multiple metal patches 103 are arranged in a lattice in equal intervals, so that an occurrence of unwanted coupling between the first feeding circuit 608 and the second feeding circuit 609 may be suppressed while setting an antenna opening to be a square to obtain the maximum antenna gain relative to the maximum antenna diameter. The multiple metal patches 103 are arranged in a lattice in a direction which is generally tilted by 45° relative to the polarization direction, so that a side lobe may be reduced while securing an interval for suppressing unwanted coupling with the first feed circuit 608 and the second feed circuit 609.

The dual-polarized antenna 600, which is set to be an array antenna, makes it possible to obtain a higher antenna gain relative to the dual-polarized antenna 200 of the first variation to be a single radiation element and to allow communications with a counterparty which is further away as an antenna of a transmitter/receiver.

The fifth variation, having the first feed circuit 608 and the second feed circuit 609 of the complete tournament-type, may simplify the circuit configuration.

While the fifth variation is arranged to include the third ground conductor 215, it is not limited thereto, so that the third ground conductor 215 may be omitted.

While the above-described fifth variation is arranged to be have the lattice direction of the multiple metal patches 103 tilted by a tilt angle of 45° relative to the polarization direction, it is not limited thereto, so that the tilt angle may be an angle different from 45°, or there may be no tilt.

In the above-described fifth variation, the excitation amplitude and the excitation phase of each of the multiple metal patches 103 may be varied to improve the antenna gain and suppress the side lobe. The division ratio of each of multiple T-type branches 610 and 611 may be set to be an equal amplitude/equal phase division or non-symmetrical division, etc., to change the excitation amplitude and the excitation phase of each metal patch 103 in a desired manner.

While the above-described fifth variation is arranged to include multiple T-type branches 610 and 611 which are connected in a multiple stage, it is not limited thereto, so that a branch circuit which divides the input power into at least three may be included in at least some of the branches in accordance with the number of multiple metal patches 103.

In the above-described fifth variation, the characteristics of each of the multiple T-type branches 610 and 611 may be set to be equal amplitude and equal phase division to excite all metal patches 103 in equal amplitude and equal phase such that the antenna gain reaches the highest. The multiple T-type branches 610 and 611, having symmetry, makes it possible to realize equal amplitude and equal phase division over a wide bandwidth and improve the wide bandwidth of the first feed circuit 608 and the second feed circuit 609.

Below, a different variation is explained.

While the dual-polarized antenna 100 is set to be a linear dual-polarized antenna, it is not limited thereto, so that it may be set to be a circular dual-polarized antenna.

Circular polarization is a combination of two orthogonal linear polarizations with a 90° phase difference. To operate the dual-polarized antenna 100 as the circular polarization patch antenna, the 90° phase difference may be set when feeding from the first feed probe 104 and the second feed probe 107 to the metal patch 103. Moreover, two corners which oppose the first metal patch 303 and the second metal patch 318 in the second variation may be cut down to a triangle to degenerate and separate two orthogonal modes.

According to at least one embodiment as described, a misalignment error may be reduced by having a patterned first feed probe on a first main surface of a second dielectric substrate and a patterned slot on a second main surface.

Having a first feed probe and a slot having mutual longitudinal directions which are generally parallel makes it possible to suppress coupling of the first feed probe and the slot to suppress an occurrence of a cross polarization component which is orthogonal to a main polarization which is parallel to the first feed probe. Having the first feed probe and the slot in which the mutual coupling is suppressed makes it possible to prevent deterioration of the cross polarization discrimination.

Moreover, the first feed probe having the longitudinal direction which is generally parallel to the longitudinal direction of the slot and the second feed probe having the longitudinal direction which is generally parallel to the longitudinal direction of the slot make it possible to improve the cross polarization discrimination.

Furthermore, the first feed probe and the second feed probe whose mutual longitudinal directions are generally orthogonal make it possible to improve isolation between an input/output in which the first feed probe is connected and an input/output port in which the second feed probe is connected.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for producing a dual-polarized antenna, the method comprising:

providing a first dielectric substrate having a first main surface and a second main surface opposite to the first main surface;

patterning a conductive film provided on the first main surface of the first dielectric substrate so as to form, on the first main surface of the first dielectric substrate, (i) a first ground conductor having an opening and (ii) a metal patch as a radiation element, the metal patch being aligned to the opening in a lamination direction;

providing a second dielectric substrate having a first main surface and a second main surface opposite to the first main surface;

patterning a conductive film provided on the first main surface of the second dielectric substrate so as to form a first feed probe on the first main surface of the second dielectric substrate, the first feed probe being configured to excite the metal patch;

patterning a conductive film provided on the second main surface of the second dielectric substrate so as to form a second ground conductor on the second main surface of the second dielectric substrate;

forming a slot in the second ground conductor by etching the conductive film provided on the second main surface of the second dielectric substrate such that (i) a longitudinal direction of the slot is generally parallel to a longitudinal direction of the first feed probe and (ii) more than half of the slot along the longitudinal direction overlaps with the first feed probe along the lamination direction;

providing a third dielectric substrate having a first main surface and a second main surface opposite to the first main surface;

patterning a conductive film provided on the second main surface of the third dielectric substrate so as to form a second feed probe on the second main surface of the third dielectric substrate, the second feed probe being generally perpendicular to the slot; and laminating the first dielectric substrate, the second dielectric substrate, and the third dielectric substrate such that the second main surface of the first dielectric substrate faces to the first main surface of the second dielectric substrate along the lamination direction and such that the second main surface of the second dielectric substrate faces to the first main surface of the third dielectric substrate along the lamination direction.

2. The method according to claim 1, further comprising:

providing a fourth dielectric substrate having a first main surface and a second main surface opposite to the first main surface; and patterning a conductive film provided on the second main surface of the fourth dielectric substrate so as to form a third ground conductor on the second main surface of the fourth dielectric substrate, wherein the laminating comprises laminating the first dielectric substrate, the second dielectric substrate, the third dielectric substrate, and the fourth dielectric substrate such that the second main surface of the third dielectric substrate faces to the first main surface of the fourth dielectric substrate along the lamination direction.

3. The method according to claim 2, further comprising:

patterning the conductive film provided on the second main surface of the third dielectric substrate so as to form a second metal patch, the second metal patch being under the second ground conductor and above the third ground conductor in the lamination direction after the laminating, and the second feed probe having a longitudinal axis which is generally perpendicular to the slot from a view parallel to the lamination direction.

4. The method according to claim 1, further comprising:

mounting at least one metal post at a periphery of the opening.

5. The method according to claim 4, wherein the opening has a rectangular shape, and wherein the at least one metal post comprises a plurality of metal posts including four pairs of metal posts, each pair of metal posts being disposed along a respective one of the four sides of the periphery of the opening.

6. The method according to claim 1, further comprising:

providing a plurality of sets each comprising the opening, the metal patch, the first feed probe, the slot, and the second feed probe;

connecting a first feed circuit to the plurality of first feed probes; and connecting a second feed circuit to the plurality of second feed probes.

7. A method for producing a dual-polarized antenna, the method comprising:

providing a first dielectric substrate having a first main surface and a second main surface opposite the first main surface;

patterning a conductive film provided on the first main surface of the first dielectric substrate so as to form a first ground conductor having an opening on the first main surface of the first dielectric substrate;

providing a second dielectric substrate having a first main surface and a second main surface opposite the first main surface;

patterning a conductive film provided on the first main surface of the second dielectric substrate so as to form, on the first main surface of the second dielectric substrate, (i) a first metal patch as a radiation element and (ii) a first feed probe, the metal patch being aligned to the opening in a lamination direction, and the first feed probe being configured to excite the first metal patch;

patterning a conductive film provided on the second main surface of the second dielectric substrate so as to form a second ground conductor on the second main surface of the second dielectric substrate;

forming a slot in the second ground conductor by etching the conductive film provided on the second main surface of the second dielectric substrate such that (i) a longitudinal direction of the slot is generally parallel to a longitudinal direction of the first feed probe and (ii) more than half of the slot along the longitudinal direction overlaps with the first feed probe along the lamination direction;

providing a third dielectric substrate having a first main surface and a second main surface opposite to the first main surface;

patterning a conductive film provided on the second main surface of the third dielectric substrate so as to form, on the second main surface of the third dielectric substrate, (i) a second metal patch as a radiation element and (ii) a second feed probe, the second feed probe being configured to excite the second metal patch; and laminating the first dielectric substrate, the second dielectric substrate, and the third dielectric substrate such that the second main surface of the first dielectric substrate faces to the first main surface of the second dielectric substrate along the lamination direction and such that the second main surface of the second dielectric substrate faces to the first main surface of the third dielectric substrate along the lamination direction, whereby the slot is positioned between the first and second metal patches in the lamination direction.

8. The method according to claim 7, further comprising:

providing a fourth dielectric substrate having a first main surface and a second main surface opposite to the first main surface; and patterning a conductive film provided on the second main surface of the fourth dielectric substrate so as to form a third ground conductor on the second main surface of the fourth dielectric substrate, wherein the laminating comprises laminating the first dielectric substrate, the second dielectric substrate, the third dielectric substrate, and the fourth dielectric substrate such that the second main surface of the third dielectric substrate faces to the first main surface of the fourth dielectric substrate along the lamination direction.

9. The method according to claim 7, wherein the first metal patch is smaller in area than the second metal patch, and wherein the second metal patch is smaller in area than the opening.

* * * * *